US007896011B2

(12) United States Patent
Grubbs et al.

(10) Patent No.: US 7,896,011 B2
(45) Date of Patent: Mar. 1, 2011

(54) METHOD OF FORMING A FILTER COMPONENT

(75) Inventors: Harvey J. Grubbs, Louisa, VA (US); Susan A. Freelin, Richmond, VA (US)

(73) Assignee: Philip Morris USA, Inc., Richmond, VA (US)

( * ) Notice: Subject to any disclaimer, the term of this patent is extended or adjusted under 35 U.S.C. 154(b) by 721 days.

(21) Appl. No.: 11/882,278

(22) Filed: Jul. 31, 2007

(65) Prior Publication Data

US 2008/0127988 A1 Jun. 5, 2008

Related U.S. Application Data

(60) Provisional application No. 60/836,145, filed on Aug. 8, 2006.

(51) Int. Cl.
*A24D 3/02* (2006.01)

(52) U.S. Cl. ..... 131/333; 493/50

(58) Field of Classification Search ..... 131/333; 493/50

See application file for complete search history.

(56) References Cited

U.S. PATENT DOCUMENTS

| | | | | |
|---|---|---|---|---|
| 2,794,239 | A | | 6/1957 | Crawford et al. |
| 2,900,988 | A | | 8/1959 | Crawford et al. |
| 2,953,838 | A | | 9/1960 | Crawford et al. |
| 3,081,519 | A | * | 3/1963 | Blades et al. ..... 57/248 |
| 3,882,877 | A | * | 5/1975 | Brackmann et al. ..... 131/332 |
| 3,950,282 | A | | 4/1976 | Gilbert et al. |
| 4,582,732 | A | | 4/1986 | Arthur |
| 4,902,378 | A | | 2/1990 | Ouderkirk et al. |
| 5,108,807 | A | | 4/1992 | Tucker |
| 5,283,505 | A | | 2/1994 | Bando |
| 5,505,830 | A | | 4/1996 | Petcavich |
| 5,647,383 | A | | 7/1997 | Brodof et al. |
| 5,709,227 | A | | 1/1998 | Arzonico et al. |
| 5,733,234 | A | | 3/1998 | Greiner et al. |
| 5,783,505 | A | | 7/1998 | Duckett et al. |
| 5,855,985 | A | | 1/1999 | O'Donnell |
| 5,911,224 | A | | 6/1999 | Berger |

(Continued)

FOREIGN PATENT DOCUMENTS

DE 4308093 A1 9/1993

(Continued)

OTHER PUBLICATIONS

Michael Stem, "Electron-Beam Processing of Plastics: An alternative to chemical additives", E-Beam Services, Inc. <www.ebeamservices.com/ebeam_spe_antec.htm>.

(Continued)

*Primary Examiner*—Carlos Lopez
(74) *Attorney, Agent, or Firm*—Buchanan Ingersoll & Rooney PC

(57) ABSTRACT

A method of forming a filter for a smoking article which includes exposing cellulose acetate fibers to an electron beam process, wherein electron beam process deacetylates the cellulose acetate fibers to render the cellulose acetate fibers water-permeable; and forming a cellulose acetate rod from a tow of the cellulose acetate fibers. Filter plugs of the cellulose acetate fibers are water-permeable and allow discarded filtered smoking articles to rapidly degrade and expose the components to the environment.

9 Claims, 2 Drawing Sheets

U.S. PATENT DOCUMENTS 5,913,311 A * 6/1999 Ito et al. ..... 131/345
5,916,929 A 6/1999 Knobel et al.
5,925,688 A 7/1999 Ash et al.
5,947,126 A 9/1999 Wilson et al.
5,954,059 A 9/1999 Beven et al.
5,970,988 A 10/1999 Buchanan et al.
5,998,500 A 12/1999 Cahill et al.
6,062,228 A 5/2000 Loercks et al.
6,133,439 A 10/2000 Buchanan et al.
6,313,202 B1 11/2001 Buchanan et al.
6,344,239 B1 2/2002 Asai et al.
6,392,035 B1 5/2002 Karstens et al.
6,506,873 B1 1/2003 Ryan et al.
6,569,990 B1 5/2003 Noda
2006/0264130 A1 * 11/2006 Karles et al. ..... 442/59

FOREIGN PATENT DOCUMENTS

EP 0597 478 B1 2/1998
GB 2117220 A 10/1983
WO WO 93/24685 12/1993

OTHER PUBLICATIONS

International Search Report and Written Opinion dated Feb. 18, 2008 for PCT/IB2007/003146.
International Preliminary Report on Patentability issued Feb. 10, 2009 for PCT/IB2007/003146.

* cited by examiner

METHOD OF FORMING A FILTER COMPONENT

CROSS REFERENCE TO RELATED APPLICATION

This application claims priority under 35 U.S.C. §119(e) to U.S. provisional Application No. 60/836,145, filed on Aug. 8, 2006, the entire content of which is incorporated herein by reference.

BACKGROUND

Smoking articles, particularly cigarettes, generally comprise a tobacco rod of shredded tobacco (also referred to as cut filler) surrounded by a paper wrapper, and a cylindrical filter aligned in an end-to-end relationship with the tobacco rod. Typically, the filter includes one or more segments of cellulose acetate tow material attached to the tobacco rod by tipping paper.

After the smoking article is consumed, the remaining tobacco rod and filter is discarded. Tobacco smoke filters, however, typically do not readily disintegrate due to the highly entangled nature of the cellulose acetate fibers, the solvents and plasticizers used to bind the fibers and crimping of the fibers.

Efforts have been expended in the past to enhance biodegradability of discarded filtered smoking articles. Despite the developments to date, there is interest in improved techniques for developing filters containing cellulose acetate fibers having an enhanced biodegradation rate.

DETAILED DESCRIPTION

Figure 1:
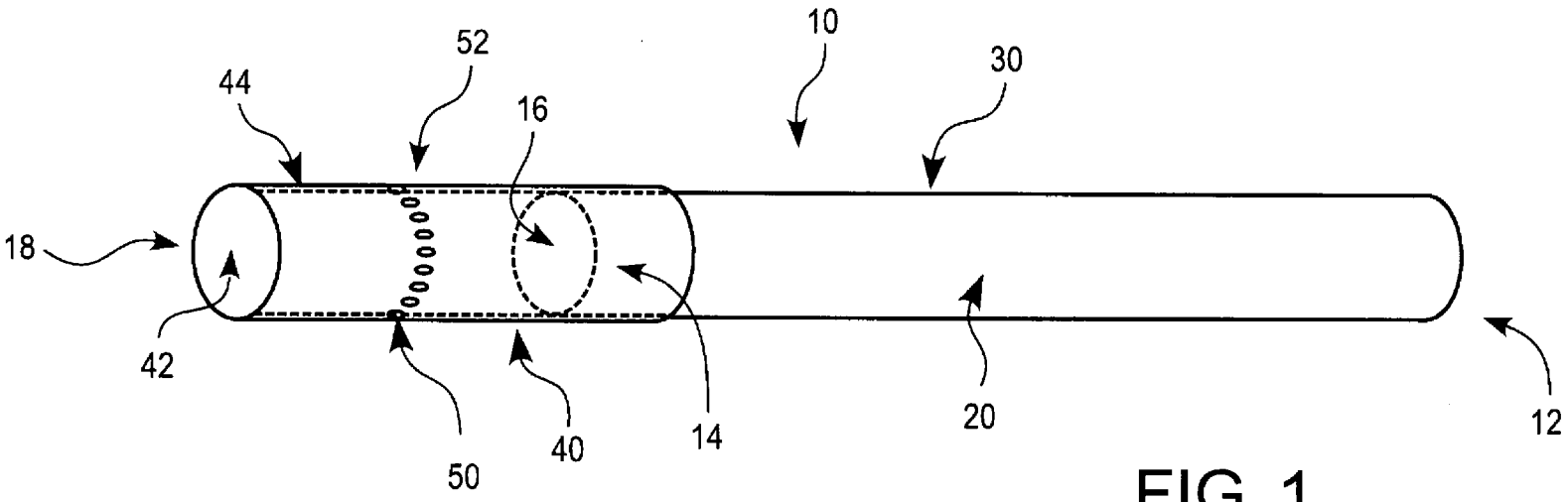
FIG. 1 shows a perspective view of a smoking article, in the form of a cigarette having a filter containing cellulose acetate fibers, which have been exposed to an electron beam process in accordance with one embodiment.

FIG. 1 shows a perspective view of a smoking article 10, in the form of a cigarette having a filter 40 containing at least one plug of cellulose acetate fibers 46 (FIG. 2), which have been exposed to an electron beam process. As shown in FIG. 1, smoking articles 10 in the form of cigarettes, typically include a generally cylindrical rod 20 of smoking material, contained in a circumscribing outer wrapper 30, and a filter 40. The outer wrapper 30 is typically a porous wrapping material or paper wrapper. The rod 20 is typically referred to as a "tobacco rod" and has a lit end 12 and a tipped end 14. The smoking material is preferably a shredded tobacco (tobacco cut filler). However, any suitable smoking material can be used.

As shown in FIG. 1, the filter 40 is adjacent to the tipped end 14 of the tobacco rod 20 such that the filter 40 and tobacco rod 20 are axially aligned in an end-to-end relationship, preferably abutting one another. The filter 40 has a generally cylindrical shape, and the diameter thereof is essentially equal to the diameter of the tobacco rod 20. The ends (i.e., upstream end 16 and downstream end 18) of the filter 40 permit the passage of air and smoke therethrough.

The filter 40 preferably includes at least one plug of filter material 42 circumscribed by a plug wrap 44. The at least one plug of filter material 42 preferably include at least one segment of cellulose acetate tow material 48 (FIG. 2), which is comprised of cellulose acetate filaments or fibers 46. The plug wrap 44 is a paper, which optionally incorporates a carbonaceous material. The plug wrap 44 circumscribes the total length of the filter 40. The filter 40 is attached to the tobacco rod 20 by a tipping material 50, which circumscribes the filter 40 and an adjacent region of the tobacco rod 20. The tipping material 50 is typically a paper like product; however, any suitable material can be used. The inner surface of the tipping material 50 is fixedly secured to the outer surface of the plug wrap 44 and the outer surface of the wrapping material 30 of the tobacco rod 20, using a suitable adhesive. It can be appreciated that in one embodiment, the adhesive is preferably a water-soluble adhesive. A ventilated or air diluted smoking article 10 can be provided with an air dilution means, such as a series of ventilation holes or perforations 52, each of which extend through the tipping material 50 and optionally the plug wrap 44.

Figure 2:
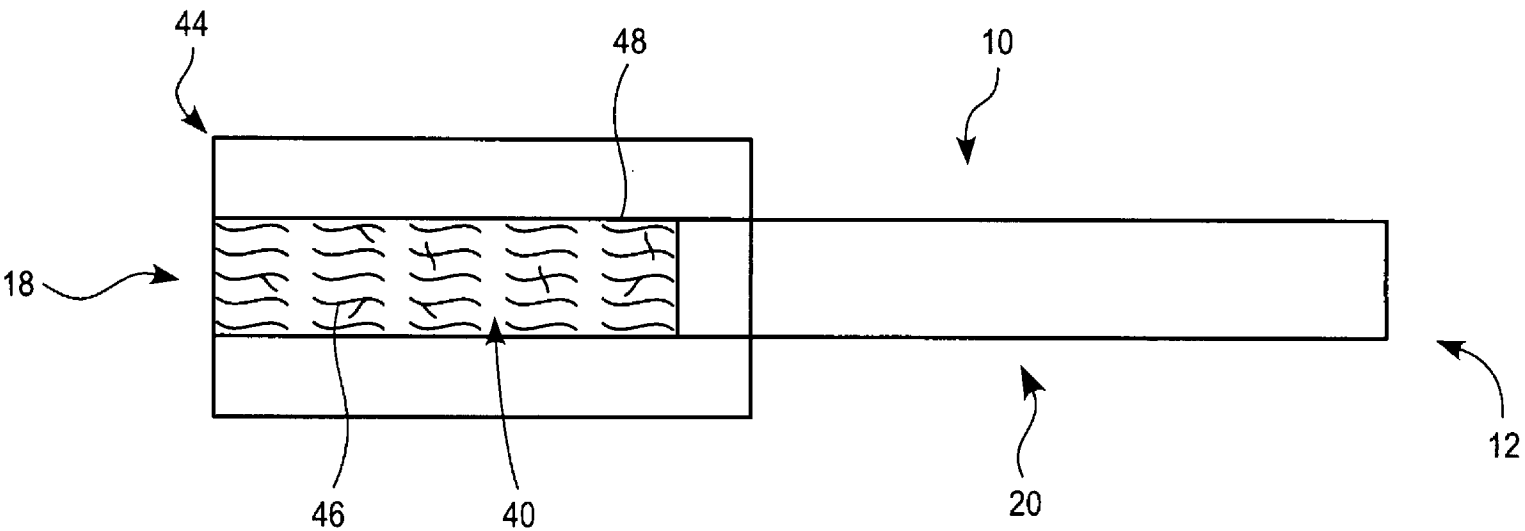
FIG. 2 shows a cross sectional view of a smoking article including a filter comprised of cellulose acetate fibers, which have been subjected to an electron beam process to deacetylate the cellulose acetate fibers.

FIG. 2 shows a cross sectional view of a smoking article 10 including a filter 40, which has been subjected to an electron beam process to deacetylate the cellulose acetate fibers 46. The deacetylating of the cellulose acetate fibers 46 imparts chain scissioning to the highly entangled cellulose acetate fibers 46, making the filter material 42 water-permeable. The water-permeable material allows the discarded smoking article 10 to rapidly degrade and disintegrate in the environment. It can be appreciated that by subjecting the cellulose acetate fibers 46 to electron radiation, many of the carbon-carbon bonds may be broken, such that the resulting radicals tend to re-link with hydrogen atoms, creating shorter polymer chains.

In addition, it can be appreciated that the cellulose acetate fibers 46 can be exposed to electron beam processing before or after the cellulose acetate fibers 46 have been manufactured into cellulose acetate tows 48, after being processed into finished tow bundles or filter plugs, after manufacturing of the smoking article 10, or after the smoking article 10 has been packaged. For example, in accordance with one embodiment, the electron beam process 60 can be used to ionize the cellulose acetate fibers 46 after the continuous monofilament or fibers 46 have been spun, and before the filament or fibers 46 are combined into a cellulose acetate tow bundle, wherein the ionization imparts chain scissioning to the continuous fibers 46, making the finished acetate tow bundle water-permeable.

The filter 40 includes one or more plugs of cellulose acetate filaments or fibers of cellulose acetate tow material 48. The cellulose acetate tow material 48 is preferably a continuous filament band of cellulose acetate fibers 46 formed from an ester of cellulose. The preferred esters of cellulose include cellulose acetate, cellulose propionate, cellulose butyrate, cellulose acetate propionate, cellulose acetate butyrate, cellulose propionate butyrate, and the like.

In addition, a plasticizer may be added to the filter tow material 48 to impart firmness to the filter plugs. The filter tow material can include 2 to 15% plastizer, such as dibutyl phthalate, tripropionin, triethylene glycol diacetate, triacetin, polyethylene glycol with molecular weights from 200 to 600 (i.e., PEG200 to PEG600), or a mixture thereof, which can be applied by either spraying the surface of the cellulose acetate fiber 46, by centrifugal force from a rotating drum apparatus, or by an immersion bath, which bonds the fibers 46 together. The plasticizer may be a water-soluble plasticizer such as the previously mentioned polyethylene glycol.

It can be appreciated that in sufficient quantities, the cellulose acetate fibers 46 dissolve in the conventional plasticizer fiber-to-fiber bonding agent. With the solvent action, the filaments become soft, and at the points where individual filaments touch, the softened surfaces fuse into a homogenous mass. These welded intersections hold the filaments firmly in position relative to adjacent filaments and an overall rigid structure results.

Figure 3:
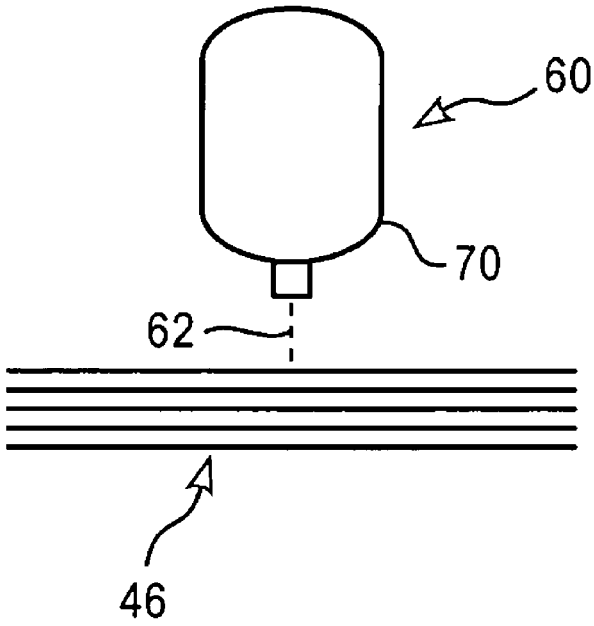
FIG. 3 shows an electron beam process to ionize cellulose acetate filament or fibers during the manufacturing of the cellulose acetate fibers.

FIG. 3 shows a method of forming a filter 40 for a smoking article 10, which includes exposing the cellulose acetate fibers 46 to an electron beam process 60, wherein the electron beam process 60 deacetylates the cellulose acetate fibers 46 to render the cellulose acetate fibers 46 water-permeable. As shown in FIG. 3, the cellulose acetate fibers 46 can be exposed to the electron beam process 60 before being manufactured into a rod of cellulose acetate tow material. The electron beam process 60 comprises an electron beam source 70, which ionizes the cellulose acetate fibers 46, and imparts chain scissioning to the acetate fibers 46, making the finished acetate tow bundle or plugs of the fibers water-permeable.

In accordance with one embodiment, the cellulose acetate fibers 46 can be modified when exposed or bombarded with radiation including accelerated charged particles, such as electrons and protons and particles emitted by the electron beam source 70. The ionization of the cellulose acetate fibers 46 preferably can be preformed using any suitable electron beam source 70.

In accordance with one embodiment for the treatment of cellulose acetate fibers 46, the radiation dose is preferably between about 0.1 and 20 kGy, wherein the radiation dose is measured in terms of the amount of radiation energy absorbed per unit mass of the material. Typically, the amount of energy absorbed, (also known as the dose), is measured in units of kiloGrays (kGy), where 1 kGy is equal to 1,000 Joules per kilogram, or MegaRads (MR or Mrad), where 1 MR is equal to 1,000,000 ergs per gram, and where 10 kGy is equal to 1 Mrad. In addition, it can be appreciated that the amount of energy absorbed is a function of a residence time or time of exposure under constant irradiation at a given dose rate to a dose level preferably in the range of 0.1 to 10 kGy, and more preferably to dose levels in the range of 0.2 to 7.0 kGy, and most preferably to dose levels in the range of 0.3 to 3.0 kGy.

The cellulose acetate tow can be prepared as described in U.S. Pat. Nos. 2,794,239, and 2,953,838, which are hereby incorporated by reference. In the manufacturing of plugs of cellulose acetate tow material 48, a cellulose pulp derived from wood or cotton fibers is mixed with acetic anhydride and acetic acid in the presence of an acid catalyst, such as sulfuric acid. The cellulose and acetic anhydride form cellulose acetate and acetic acid. In the acylation of cellulose, an average of approximately 2.9 of the 3 available hydroxyl groups are acylated or substituted with the acetate. Next, the polymer is hydrolyzed to the level of substitution of approximately 2.5, which forms cellulose acetate in a flake form. The cellulose acetate flake is then dissolved in acetone to form a viscous solution. A whitening agent, such as titanium dioxide may be added.

The viscous solution is then filtered and spun into filaments through an extrusion process by forcing the cellulose acetate solution under high pressure through a spinerette having tiny holes to thereby form individual acetate filaments. The holes in the spinerette may have varying shapes, such as square, triangular and round. Triangular shaped holes result in a trilobal or Y-shaped filament, which has been shown to have a high surface area versus weight, desirable for efficient smoke filtration. After the cellulose acetate solution is pressurized through the spinerette, the fibers fall from the spinerette in fine streams downward through a curing chamber where warm air evaporates the acetone and solidifies the streams of cellulose acetate into separate fibers or filaments 46.

The filaments or fibers 46 are then combined into a tow band and put through a crimping process. The crimping process is performed by feeding the tow band of uncrimped fibers 46 into a crimping chamber. The tow band is fed into the crimping chamber with feed rollers. The crimping chamber has means for restraining the movement of the tow band out of the crimp chamber, which imparts a zig-zag crimp formation to the tow band. The crimping process entangles the fibers 46 and improves the filtration efficiency.

The crimped tow band is then dried and laid out in a specified pattern to form a bale. The pattern is such that the tow band can be easily pulled out of the bale at a high rate of speed in the future by a customer. The bale is compressed and then used to manufacture filter rods. The filter rod is a wrapped filter element having a length, which is usually four or six times the length of an individual filter element attached to a cigarette 10. Filter rods 40 may have a similar diameter as the cigarettes 10 in which they are used and may be covered by white paper (or plug wrap). A process for producing filter rods is described in U.S. Pat. No. 2,900,988, which is hereby incorporated by reference.

Figure 4:
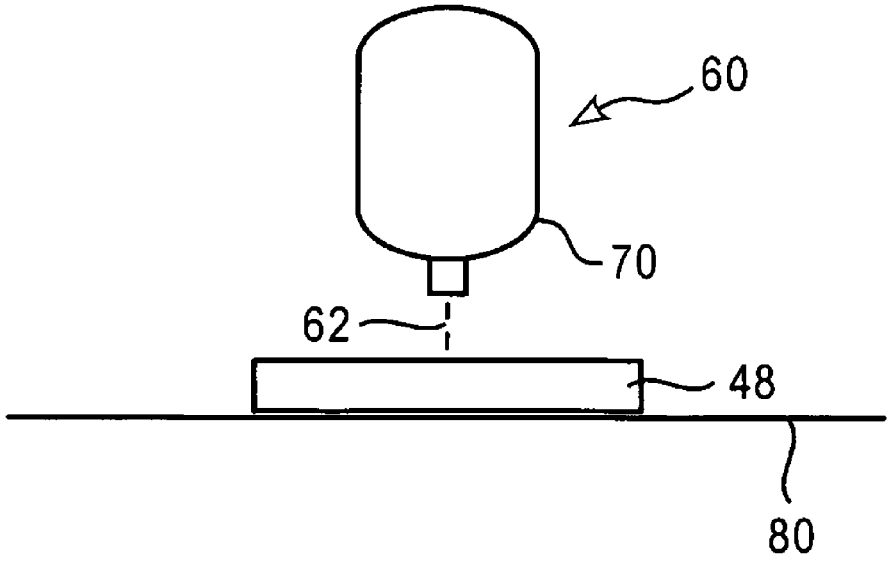
FIG. 4 shows an electron beam process to ionize the cellulose acetate fibers of a finished tow bundle or filter rod.

FIG. 4 shows an electron beam process to ionize the cellulose acetate fibers 46 formed into a filter rod of two material 48. As shown in FIG. 4, it can be appreciated that the cellulose acetate fibers 46 can be exposed to the electron beam processing 60 during any portion of the manufacturing process of the filter 40, including during the formation of the cellulose acetate flakes, the formation of the cellulose acetate filament or fibers 46, or after the tow bundle material 48 has been formed in the crimping process. It can be appreciated that in a preferred embodiment, the cellulose acetate fibers 46, whether in the form of a cellulose acetate flake, a dry spun fiber or a completed filter rod can be passed under the electron beam source 70 using a device or apparatus such as a conveyors or conveyor belt 80, carts, reel-to-reel equipment, or other specialized handling means.

Alternatively, the electron beam processing 60 can be applied to the filter tow material 48 during manufacturing of the filter 40. For example, after the fiber-to-fiber bonding agent is applied to the fibers 46, in a tow condensing and wrapping process, as the bundle of fibers 46 are wrapped with plug wrap forming a filter rod, the filter rod can be exposed to the electron beam process 60. The finished filter rod includes a plug wrap adhesive, which is applied to one side of a plug wrap paper, and the adhesive treated tipping paper attaches filter 40 to tobacco rod 20. In addition, it can be appreciated that the finished filter 40 can be treated with an electron beam process 60.

In addition, the electron beam processing 60 can be used in the formation of the continuous monofilament or fiber 46, including after the continuous monofilament 46 has been spun, after the continuous monofilament 46 has been spun and dried, during formation of a filter rod in the plasticizer booth after blooming, or used on a finished filter rod. In addition, it can be appreciated that the electron beam process 60 can also be used on the finished filter 40 at any point used to convey finished filters to cigarette manufacturing processes or cigarette making after tipping, or in the packing process on pack or carton drying conveyors, or case conveyors, including wherein the electron beam processing 60 can be used on cases of finished cigarettes outside of a manufacturer thereof but within the control of the manufacturer, or at a finished goods warehouse.

If the electron beam processing 60 is applied to finished cigarettes, the processing may further include electron beam treatment of the cigarette to reduce or eliminate microbes and/or cigarette beetles or other pests in conjunction with the aforementioned electron beam processing for biodegradability.

It will be understood that the foregoing description is of the preferred embodiments, and is, therefore, merely representative of the article and methods of manufacturing the same. It can be appreciated that many variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

All of the above-mentioned references are herein incorporated by reference in their entirety to the same extent as if each individual reference was specifically and individually indicated to be incorporated herein by reference in its entirety.

What is claimed is:

1. A method of forming a filter component comprising:

forming fibers comprising cellulose acetate;

exposing said formed cellulose acetate fibers to an electron beam process, wherein the electron beam process deacetylates at least some of the cellulose acetate fibers, whereby at least some of the cellulose acetate fibers are rendered water-permeable; and forming a filter component from the cellulose acetate fibers.

2. The method of claim 1, wherein the exposing of the cellulose acetate fibers to the electron beam process is applied to filter tow material after the fibers have been put through a crimping process.

3. The method of claim 1, wherein the exposing of the cellulose acetate fibers to the electron beam process is applied to a smoking article including the filter component.

4. The method of claim 3, wherein the smoking article is a cigarette.

5. The method of claim 1, wherein the electron beam process comprises exposing the cellulose acetate fibers to no more than 7.0 kGy of electron ionization.

6. The method of claim 1, wherein the electron beam process comprises exposing the cellulose acetate fibers to no more than 3.0 kGy of electron ionization.

7. The method of claim 1, wherein the cellulose acetate fibers are formed from an ester of cellulose.

8. The method of claim 1, wherein the filter component disintegrates biodegradably in less than one week.

9. The method of claim 4, further comprising application of electron beam treatment to the cigarette to abate a pest.

* * * * *